United States Patent [19]

Ching

[11] Patent Number: 4,974,344

[45] Date of Patent: Dec. 4, 1990

[54] SHOE WITH INTERCHANGEABLE VAMP AND SOLE

[76] Inventor: Peng J. Ching, 9-1, Lane 161, Hsing An Road, Sec. 1, Taichung, Taiwan

[21] Appl. No.: 399,611

[22] Filed: Aug. 9, 1989

[51] Int. Cl.[5] ..... A43B 3/24

[52] U.S. Cl. ..... 36/101; 36/100; 36/15

[58] Field of Search ..... 36/101, 100, 15, 17 PW, 36/12

[56] References Cited

U.S. PATENT DOCUMENTS

| | | | |
|---|---|---|---|
| 1,497,852 | 6/1924 | Hooper | 36/15 |
| 1,639,381 | 8/1927 | Manelas | 36/15 |
| 2,178,025 | 10/1939 | Richter | 36/101 |
| 2,552,943 | 5/1951 | Damelius | 36/15 |
| 4,343,057 | 8/1982 | Bensley | 36/101 |

*Primary Examiner*—Steven N. Meyers

[57] ABSTRACT

The present invention provides a shoe with interchangeable vamp and sole which comprises a sole (10) with a heel (11) which an air inlet guide (14) is formed in and with an air inlet hole (111) located at the bottom, exposed portion; a guide hole (141) located at the inside, near the rearmost of the portion of the sole (10); a receiving channel (12) with a channel inlet (121) and a channel cavity (122); a plurality of annular segments (13) which are put in the channel cavity (122); an upper-shoe assembly (20) which has a vamp (21), an insole (22); a welt (211) which extends downward from the connected portion of the vamp (21) and the sole (22), a gas bladder (24) with an air inlet (241) and a bladder glove (23); by inflating or deflating the gas bladder (24), the vamp and the sole could be interchanged with the same size of device.

3 Claims, 4 Drawing Sheets

SHOE WITH INTERCHANGEABLE VAMP AND SOLE

BACKGROUND OF THE PRESENT INVENTION

The present invention relates to shoes; more particularly, it relates to the structure of shoes which soles and vamps can be replaced.

Accordingly, the prior art concerning the soles and vamps of shoes that can be replaced teaches the use of hook and loop fasteners and zipper fasteners. As shown in FIG. 1, the hook and loop fasteners 3 are respectively attached to the bottom surface of an upper shoe 2 and the inner surface of a sole 1. Two zipper fasteners 4 respectively surrounds the lower edge the upper shoe 2 and the periphery of the sole 1. Attach the upper shoe 2 to the sole 1 with the hook and loop fasteners 3 respective to each other so that the upper shoe 2 will be slightly in connection with the sole 1. Then by means of a sliding tab 5, being located on the zipper fastener 4 of the sole 1, the sole 1 and the upper shoe 2 are engaged with the zipper fasteners 4. Prima facie the soles and vamps of shoes can be interchanged in this way; somehow the zipper fastener, from the viewpoint of materials is not suitable to be used as a connection means for the engagement of a shoe, especially in welt portion, because of the shape of the periphery of shoes and the unsymmetry of the two toothed edges after frequent movement of human feet. Surely when the zipper fastener is not workable, the hook and loop fasteners will be useless. Finally, the zipper fastener ruins the aesthetic appearance of shoes.

OBJECTS OF THE PRESENT INVENTION

The main object of the present invention is to provide a shoe with interchangeable vamp and sole to be firmly engaged after easy replacing and engaging manners. Another object of the present invention is to provide a shoe being able to interchange its vamp and sole without any additional outside apparatus to ruin the appearance of shoe.

SUMMARY OF THE PRESENT INVENTION

The present invention provides a shoe with interchangeable vamp and sole, comprising a sole, an upper-shoe and gas bladder means. The sole has a receiving channel which includes a channel inlet and a channel cavity. The gas bladder means includes a gas bladder and a gas bladder glove. An air inlet is formed on the gas bladder. The upper-shoe has a welt connecting with the gas bladder glove, therein the gas bladder being inserted, by sewing manner. The connected portion is inserted into the channel cavity through the channel inlet. By inflating the gas bladder, the sole and the upper shoe are then firmly engaged. By deflating the air from the gas bladder, the sole and the upper-shoe are separable. The sole and the upper shoe, therein including gas bladder means, are interchangeable with other shoes, having the same size and structure in design, and vice versa.

BRIEF DESCRIPTION OF THE PRESENT INVENTION

DETAILED DESCRIPTION OF THE PREFERRED EMBODIMENT

Figure 1:
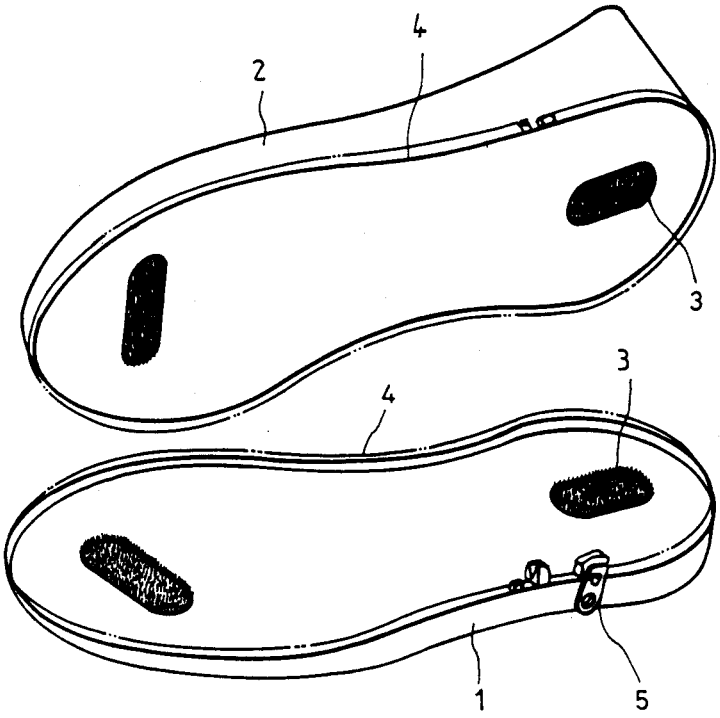
F I G. 1 PRIOR ART
FIG. 1 is a perspective plane view of a conventional shoe that the sole and the upper-shoe can be replaced and connected by hook and loop fasteners and a zipper fastener.
Figure 2:
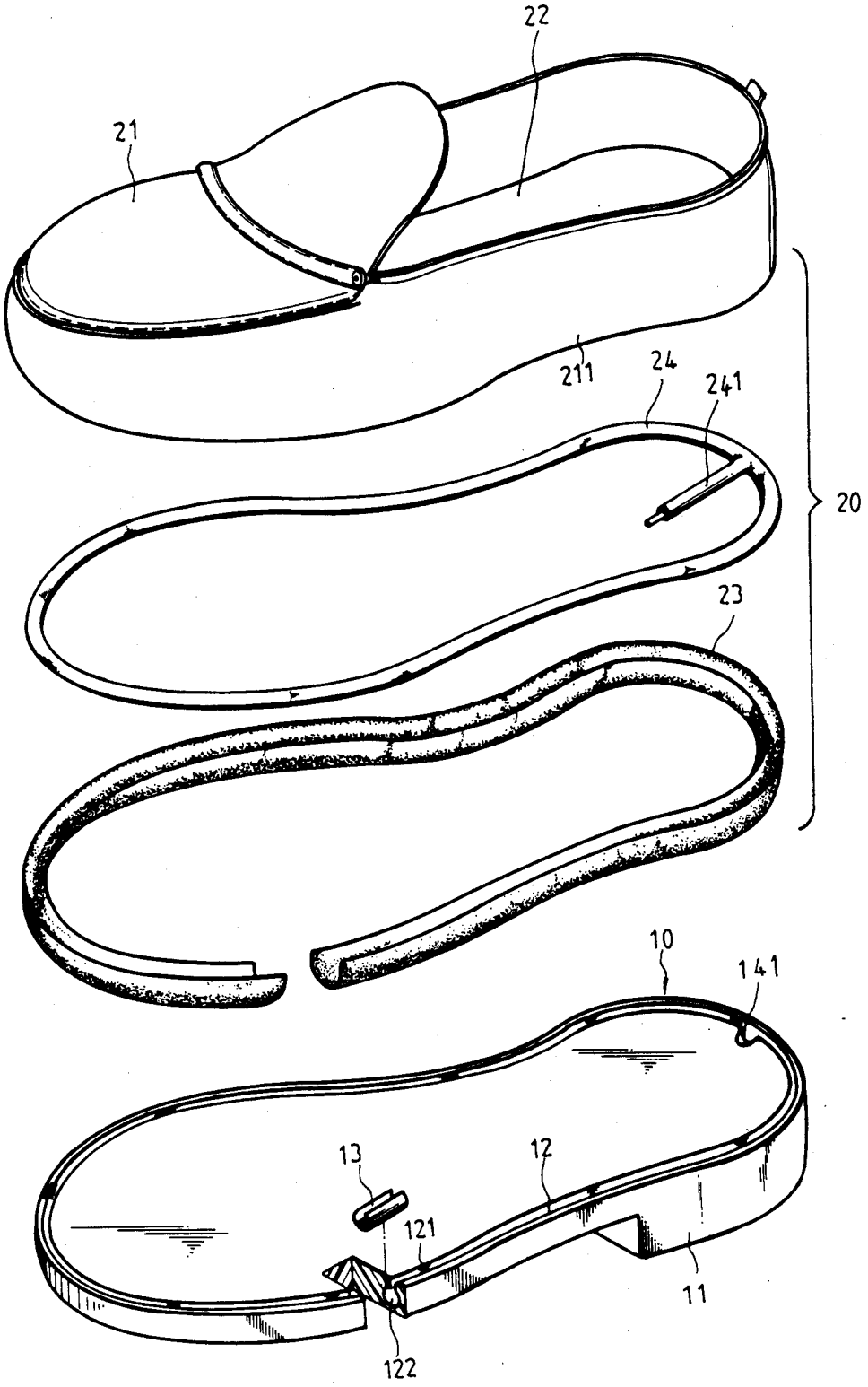
FIG. 2 is a perspective plane view of the preferred embodiment of the present invention.
Figure 3:
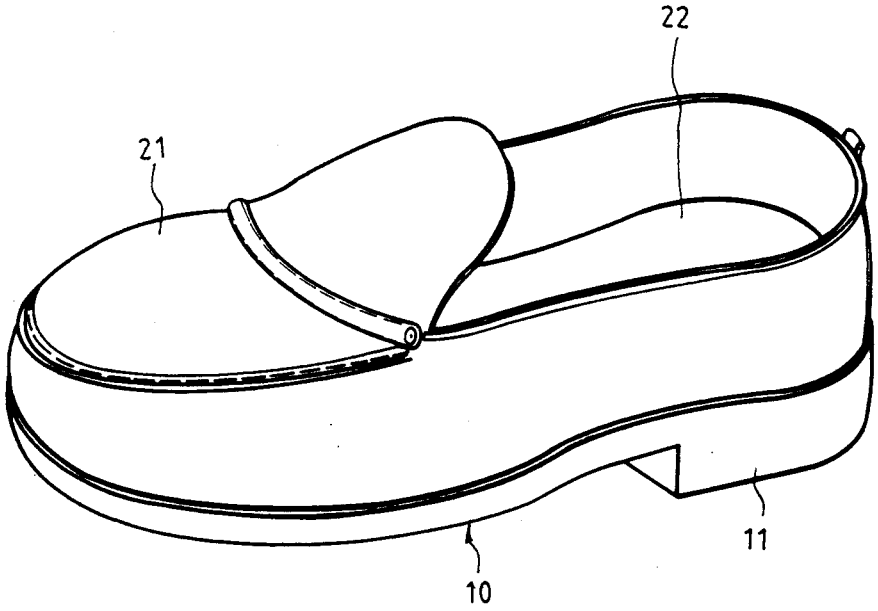
FIG. 3 is an assembled view of the preferred embodiment of the present invention.

Please refer to FIG. 2, the present invention provides a shoe with interchangeable vamp and sole which comprises: a sole 10 and an upper-shoe 20. The periphery of the sole 10 has a receiving channel 12 including a channel inlet 121 and a channel cavity 122, extending downwardly from the channel inlet 121 and forming under the channel inlet 121. A plurality of annular segments 13, being in a C shape corresponding to the inner surface of the channel cavity 122 and made of high elastic yet firm materials, are provided to be inserted into the channel cavity 122. A heel 11 is formed under the rear portion of the sole 10. An air inlet hole 111 is located at the front and unexposed portion of the heel 11 near the lower edge. A guide hole 141 is located at the rear upper exposed portion of the heel 11 near the rearmost of the portion of the sole 10. As the air inlet hole 111 and the guide hole 141 its both end openings, an air inlet guide 14 is formed inside the heel 11. The upper-shoe 20 has a vamp 21, an insole 22, a welt 211. The welt 211 extends downwardly from the connected portion of the vamp 21 and the insole 22. A bladder glove 23 is hollow and made of high elasticity. A gas bladder 24, corresponding to the size of the sole 10, is provided to be inserted into the channel cavity 122 through the channel inlet 121. Extending outwardly from the gas bladder 24, is formed an air inlet 241, being corresponding to the length of the air inlet guide 14, to ensure the air inlet 241 to pass therethrough. The gas bladder 24 is inserted into the bladder glove 23. (see FIG. 4)

OPERATION OF THE PRESENT INVENTION

Figure 4A:
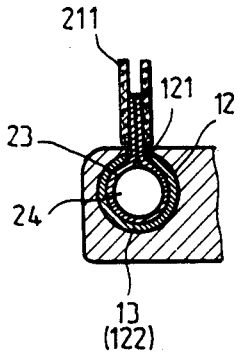
FIG. 4A is a cross sectional close-up view of FIG. 4
Figure 4:
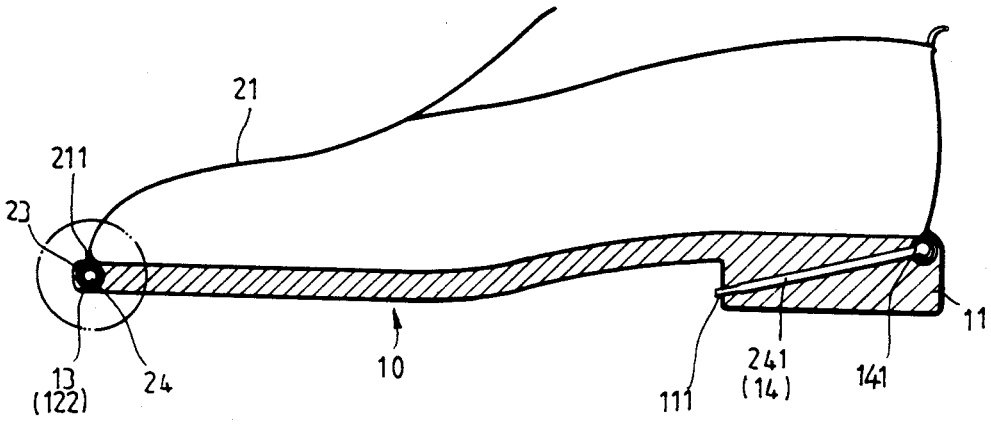
FIG. 4 is a side view of the preferred embodiment of the present invention.

Please refer to FIG. 2, 4 and 4A, first, insert the deflated gas bladder 24 into the bladder glove 23, after the insertion, both edges of the bladder glove 23 will stretch out from the outside surface of the gas bladder 24, namely extending portion. Then surround the welt 211 on the outer surface of the extending portion with its inner surface and connect them together by sewing manner. Before inserting the sewed portion into the channel cavity 122 through channel inlet 121 of the receiving channel 12, make sure the annular segments 13 have already been placed in the channel cavity 122. When the gas bladder 24 is inserted into the channel cavity 122, insert the air inlet 241 into the air inlet guide 14 through the guide hole 141 and make the end of air inlet 14 slightly protrude out from the air inlet hole 111 first. Inflate the gas bladder 24 from the air inlet 241 until the sole 10 and the upper shoe 20 being in firm engagement and the annular segments 13 being pushed firmly against the inner surface of the channel cavity 122. The present invention, namely the shoe with interchangeable vamp and sole, is completely assembled. When the user wants to change the vamp or the sole, what he has to do is to deflate the gas bladder 24 and change another sole or vamp with the same size of device and follow the above-mentioned steps to connect these two parts together, then inflate the gas bladder 24 by the air inlet 241 again.

I claim:

1. A shoe with interchangeable vamp and sole, comprising:

an upper shoe being connected with a sole by a gas bladder means;

said upper shoe having a vamp portion, an insole portion and a welt portion thereof;

said gas bladder means including a gas bladder and a bladder glove, and an air inlet extending from said gas bladder;

said sole having a heel, an air inlet guide, a receiving channel and a plurality of annular segments;

said air inlet guide housing in said heel and having an air inlet hole and a guide hole as its opening; said air inlet for permitting said air inlet of said gas bladder to be passed therethrough;

said guide hole being formed on the rear portion of said heel at its upper end, said air inlet hole being formed on the front portion of said heel near the lower edge and obliquely opposed to said guide hole;

said receiving channel including a channel inlet being mounted adjacent to the periphery of said sole, and a channel cavity extending downwardly from said channel inlet, said channel inlet for defining a gas bladder entrance to said channel cavity, said gas bladder glove being placed between the inner surface of said channel cavity and the outer surface of said gas bladder and extending upwardly and passing through said channel inlet.

2. A shoe with interchangeable vamp and sole according to claim 1, wherein said plurality of annular segments being made of highly elastic yet firm materials, formed in a C shape therewith corresponding to the inner surface of said channel cavity, and placed between the inner surface of said channel cavity and the outer surface of said gas bladder.

3. A shoe with interchangeable vamp and sole according to claim 1, wherein said welt portion extends downwardly from said insole and connects with the upwardly extending portion of said gas bladder glove.

* * * * *